US008499593B2

(12) United States Patent
Van De Sluis et al.

(10) Patent No.: US 8,499,593 B2
(45) Date of Patent: Aug. 6, 2013

(54) APPARATUS FOR WAKING UP A USER

(75) Inventors: Bartel Marinus Van De Sluis, Eindhoven (NL); Anthonie Hendrik Bergman, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 251 days.

(21) Appl. No.: 12/991,730

(22) PCT Filed: May 7, 2009

(86) PCT No.: PCT/IB2009/051878
§ 371 (c)(1), (2), (4) Date: Nov. 9, 2010

(87) PCT Pub. No.: WO2009/138918
PCT Pub. Date: Nov. 19, 2009

(65) Prior Publication Data

US 2011/0058456 A1 Mar. 10, 2011

(30) Foreign Application Priority Data

May 13, 2008 (EP) ..... 08156105

(51) Int. Cl.
*G04C 21/16* (2006.01)

(52) U.S. Cl.
USPC ..... 68/256; 368/10; 368/12; 368/73

(58) Field of Classification Search
USPC ..... 368/256; 362/249.09; 33/270
See application file for complete search history.

(56) References Cited

U.S. PATENT DOCUMENTS

| | | | | |
|---|---|---|---|---|
| 5,008,865 | A * | 4/1991 | Shaffer et al. | 368/10 |
| 5,079,682 | A * | 1/1992 | Roberts | 362/276 |
| 5,134,597 | A * | 7/1992 | Bradt | 368/223 |
| 5,327,331 | A * | 7/1994 | Roberts | 362/176 |
| 5,434,756 | A * | 7/1995 | Hsu et al. | 362/552 |
| 6,236,622 | B1 | 5/2001 | Blackman | |
| 6,276,811 | B1 * | 8/2001 | Yoshimori et al. | 362/192 |
| 6,309,094 | B1 * | 10/2001 | Woerner | 362/539 |
| 7,038,398 | B1 * | 5/2006 | Lys et al. | 315/291 |
| 7,280,439 | B1 * | 10/2007 | Shaddox | 368/73 |
| 2003/0080872 | A1 * | 5/2003 | Gutta et al. | 340/691.3 |
| 2003/0095476 | A1 | 5/2003 | Mollicone et al. | |
| 2006/0028921 | A1 * | 2/2006 | Wang et al. | 368/238 |
| 2006/0133215 | A1 * | 6/2006 | Gordon et al. | 368/79 |
| 2007/0070819 | A1 * | 3/2007 | Choksi et al. | 368/76 |

FOREIGN PATENT DOCUMENTS

| | | | |
|---|---|---|---|
| GB | 2422447 | A | 7/2006 |
| GB | 2432414 | A | 5/2007 |
| JP | 07318670 | A | 12/1995 |
| WO | 2007061031 | A1 | 5/2007 |

* cited by examiner

*Primary Examiner* — Vit W Miska
*Assistant Examiner* — Matthew Powell
(74) *Attorney, Agent, or Firm* — John F. Salazar; Mark L. Beloborodov

(57) ABSTRACT

An apparatus for waking up a user, the apparatus (1) comprising a light source (3) that is adapted to produce a light effect (L), such as a light beam, that is directed to a user, or at least to a user's head, wherein the apparatus (1) comprises means for displacing the light effect (L) in an upward ($R_u$) or downward ($R_d$) direction during a period of time, in order to change a position of the light effect with respect to the user, or at least to the user's head, wherein the means to displace the light effect (L) is adapted to displace the light effect (L) gradually along an amount of displacement during the time period, for instance during a wake-up period until reaching a final wake-up time.

13 Claims, 6 Drawing Sheets

APPARATUS FOR WAKING UP A USER

FIELD OF THE INVENTION

The invention relates to an apparatus for waking up a user, the apparatus comprising a light source that is adapted to produce a light effect, such as a light beam, that is directed toward a user.

BACKGROUND OF THE INVENTION

Such apparatuses are known from practice. An apparatus for waking up a user can comprise a light source that produces a light effect with a low intensity at a beginning of a wake-up period of a user. The intensity of the light effect gradually increases during the wake-up period until the light effect reaches a relatively high intensity at the final wake-up time of the user. By doing so, the brightness of the light effect and the color temperature of the light effect changes. Such an apparatus, also known as a light alarm clock or the like, simulates a pattern of a natural sunrise. By using such an apparatus, the user is woken-up gradually over a period of time between the beginning of the wake-up period and a final wake-up time, preferably substantially close to the final wake-up time. By increasing the light intensity, the brightness and color temperature of the light source of the apparatus, the user is woken in a pleasant gentle way and not in an abrupt way such as by a loud alarm in most conventional alarm clocks.

Research has shown that a person that is woken up by the increasing light intensity, wakes up feeling better and having more energy than with an ordinary alarm clock. Thus, the gradually increasing light effect has a positive effect on energy hormones and the overall physical condition of the user.

SUMMARY OF THE INVENTION

It is therefore an object of the invention, to provide an improved apparatus for waking up a user of the above described type. More particular, it is an object of the invention to provide an improved apparatus for waking up a user, which apparatus enables a more natural sunrise simulation.

To that end, an apparatus according to the invention is characterized in that the apparatus comprises means for displacing the light effect in an upward or downward direction during a period of time, in order to change a position of the light effect with respect to the user, or at least to the user's head.

By displacing the light effect of a light source in an upward direction during the wake-up period of a particular user, the sunrise simulation resembles a natural sunrise in a more convincing way, thereby increasing the gentle way of waking up the user of the apparatus. The apparatus according to the invention can also be used during a period before falling asleep. The light effect will start on a relatively high position with respect to the user and will move in a downward direction in order to simulate sunset. The time period can for instance be a predetermined time period, a time period related to the time of the year or a time period defined by the user. It is noted that the light effect can comprise different kinds of light radiation patterns such as a light beam, a light ray, a light spot, diffused light, and the like. Therefore, light effect should not be interpreted narrowly, but including all different kinds of patterns. Furthermore, in this embodiment, the light effect is displaced gradually during the time period. The means to displace the light effect may be arranged to start displacing the light effect at a start position, then to continuously displace the light effect along said amount of displacement, and to end displacing the light effect at an end position. The light effect can start at a certain position with respect to a user's head, for instance substantially at the same level, and is displaced, for instance during the wake-up period until the user's final wake-up time is reached, along a certain amount of displacement. For instance, in an upward direction along a certain amount of centimeters. Of course, it is also possible to displace the light effect in a downward direction during a time period, for instance during the falling asleep period until the user falls asleep. The amount of displacement may for instance comprise a linear or arc like displacement path.

According to a further elaboration of the invention, the apparatus can be defined by the features of claim 4. In this embodiment, the sunrise is simulated by a light effect that is produced by a displaceable light source. Before the start of the wake-up period, the light source has a certain height level, preferably lower than the user's head, and the bed border can be instrumental for simulating a horizon. When the wake-up period starts, the light source will be displaced in an upward direction, thus in a direction upward from the head of a user, thereby simulating a sunrise. According to an embodiment of the invention, the light source can be arranged such that it is displaced by sliding it along a sliding element arranged in the apparatus. It is also possible according to another aspect of the invention that the light source is provided on an extendable rod. It is further possible according to another aspect of the invention that the light source is provided on a rotating element that in use rotates with respect to a stationary part of the apparatus, in order to displace the light source in an upward or downward direction. In this embodiment, the light source will not describe a linear path during displacement, but an arc like path.

An alternative embodiment of the apparatus according to the invention is defined in claim 7. In this embodiment multiple light sources are substantially arranged in line and are adapted to be switched on and off subsequently in order to displace the light effect in the upward or downward direction. In fact, the light effect is moved upward by gradually shifting from the lowest to the highest light source. Such multiple light sources can be formed by a line of LED units, which are controllable in such a way that the light effect seems to gradually shift along the respective LEDs. In addition, the intensity and the color temperature can be adjusted gradually, for instance by controlling each LED in a different way. In further elaboration of the invention, the multiple light sources may comprise LED units of multiple different colors, which enables mimicking the change in perceived light color during a sunrise. The LED units may for instance comprise at least one neutral white LED unit, at least one warm white LED unit, at least one amber LED unit and at least one red LED unit. The at least one red LED unit could be, for example, a red LUXEON Rebel or LUXEON Rebel ES LED unit as available from Philips Lumileds. The LED units of different colors may be arranged in line, for instance the red LED unit being arranged at the bottom and the neutral white unit LED unit being arranged at the top. In a different embodiment of the invention more than one line of LED units, for instance two lines arranged substantially parallel, may be provided. According to a further aspect of the invention, the means for displacing the light effect may further comprise at least one of a lens and a diffuser. The lens and/or the diffuser may be positioned adjacent the multiple light sources, such that in use the light effect passes the lens and/or the diffuser. In case the means for displacing the light effect comprises a lens, the line of LED units may be arranged such that the neutral white LED unit is located at the bottom and the red LED unit is located at the top. By providing the lens, the light effect may result in distinct light spots or light spots that partly overlap, in this case four light spots, that are projected subsequently, dependent on the control of said respective LED units. The projection of two adjacent light spots may also partly occur simultaneously. Thus, a subsequent LED unit may already be controlled to start emitting light as the previous LED unit is still emitting light or as the previous LED unit at the same time is controlled to decrease the emission of light. The lens may for instance be a Fresnel lens. A diffuser, such as a holographic diffuser, may be provided adjacent the lens at a side facing away from the multiple light sources. The diffuser may be arranged to smooth the light effect spots. The apparatus may comprise a control unit to control the individual LED units such that the color and/or the intensity of the light effect produced by the LED units may be controlled. In an advantageous embodiment of the invention, the multiple LED units may be mounted on a heat sink. Such a configuration of the means for displacing the light effect is very small and may be used to advantage in an apparatus for waking up a user. In further elaboration of the invention, the light sources are positionable in order to position each light source individually to direct each respective light effect produced by the respective light source in a different direction. For instance, the lower light sources may be directed slightly upwards, the middle light sources can be directed substantially horizontal and the higher light sources can be directed slightly downwards.

According to another alternative embodiment of the invention, the apparatus is defined by the features of claim 11. This embodiment of the invention provides the displacement of the light effect by a stationary, at least in upward and/or downward direction, light source and a movable reflector arranged adjacent to the light source or by a stationary reflector and a movable light source. In case the light source is stationary, the reflector may be arranged rotatable around a rotational axis provided substantially perpendicular to said upward and/or downward direction with respect to the light source, such that the light effect is displaced by rotating the reflector relative to the light source. In case the reflector is arranged stationary, the light source may be arranged around a rotational axis provided substantially perpendicular to said upward and/or downward direction with respect to the reflector, such that the light effect is displaced by rotating the light source relative to the reflector. The reflector may be an arc shaped reflector.

A further embodiment of the apparatus according to the invention is defined in claim 13. In this embodiment, the light effect is displaceable by means of a Fresnel lens arrangement. The Fresnel lens arrangement comprises an array of Fresnel lenses and the arrangement is arranged adjacent a stationary light source. By only displacing the Fresnel lens arrangement in an upward direction with respect to the light source, the light effect will displace in an upward direction as well and vice versa.

According to a further elaboration, the apparatus according to the invention is defined in claim 15. In this embodiment, the apparatus comprises a control unit. Such a control unit is adapted for setting and controlling at least one parameter of the apparatus for waking up a person. The control unit can control a user's final wake-up time and/or a length of the user's wake-up period until the final wake-up time is reached. The user can also determine the starting intensity and/or the end intensity of the light effect and also the start and/or end position of the light effect. Due to such control unit, the apparatus may be controlled according to a user's personal preferences. For instance, the user can decide on a length of an appropriate wake-up period, the final wake-up time and the end intensity of the light effect. Furthermore, such a control can be adapted to set multiple settings for instance separate settings for weekdays and different settings for the weekend or even to set the personal preferences for different users.

A further embodiment of the apparatus according to the invention is defined in claim 16. In this embodiment, the apparatus can be adapted to start the light effect with a relatively low intensity at a beginning of the wake-up period. The intensity, thus also the brightness and color temperature, is increased during the wake-up period and reaches a final high intensity at the final wake-up time. Of course, the apparatus can start the light effect with a relatively high intensity and then decrease the intensity of the light effect to a low intensity, or no intensity at all when the light effect is shut off. This can be very advantageous to help a user falling asleep. Also other patterns of changes in intensity during a time period are possible if defined and set in the control unit. The apparatus can be arranged, according to a further elaboration of the invention to start displacing the light effect at a beginning of the wake-up period and to end displacing the light effect at a final wake-up time. The light effect can rise simultaneously with the increase in intensity of the light effect. The light effect can also set simultaneously with a decrease in intensity of the light effect, to simulate a sunset in order to help a user to fall asleep.

According to a further elaboration of the invention, the apparatus according to the invention is defined by claim 18. The light source can be controlled such that it subsequently produces a light effect with a different intensity, for example by subsequently turning the light source on and off during a time period. For instance, when the final wake-up time is reached and the light source produces a light effect with a relatively high intensity, the light source can be controlled to start blinking. Therefore, the light intensity can be subsequently turned on and off, or the light intensity can be subsequently increased and decreased. The blinking light source provides for a better waking up efficiency of the apparatus. Blinking has a stronger wake up power to wake-up a sleeping user than a relatively constant light effect. Of course it is possible to change the control settings such that the blinking option is activated or deactivated when desired, for instance during the weekend.

In a further embodiment, the apparatus according to the invention is defined by claim 19. In this embodiment of the invention, the apparatus also comprises an infrared source. Such an infrared source enables the apparatus to produce warmth as well as light. When waking up a user, the user can be gradually exposed to light but also to warmth, thereby further approaching a natural sunrise. According to a further elaboration of the invention, the degree of warmth can be varied during the predetermined time period, for instance starting relatively cold and increasing during the time period. The user experiences light and warmth during waking up, just like when a sun is shining on his face.

According to a further elaboration of the invention, the apparatus can comprise connecting means to operably connect the apparatus to external devices such as a television, an audio system or other available light sources and the like, for instance for using these devices to program the desired wake up time or falling asleep period or add rendering capabilities of the devices to an effect of the apparatus. An external device such as the television, an electronic display, touch screen, mobile phone or the audio system can be used to program the desired wake-up time and other settings or to add rendering capabilities of the devices to an effect of the apparatus. In that way, the apparatus according to the invention can be controlled by the external device or the apparatus can control the external device, for instance, the audio system can create sound during the wake-up process, and the television can be switched on at the end of the wake-up process. The apparatus can for example also be connected to other light sources available in the room. The apparatus can for instance switch on the ceiling lights when the sunrise is completed, thus when the light effect reaches the highest set position and/or the highest set intensity.

In a further embodiment of the apparatus according to the invention is defined in claim 21. The projection means of this embodiment provide the possibility to project an image on to a ceiling or a wall. For instance, a morning sky, a moon, a star heaven or the like can be projected onto the mentioned surface. It is possible according to a further elaboration of the invention, that such a projected image is related to an actual weather forecast. Thus, when rain is predicted, an image of a cloudy sky may be projected. It is also possible to project the actual time for instance on the ceiling, such that a user lying in bed can easily see what time it is. The approximate time can also be communicated in a more subtle way, for instance the position of the moon, or the amount of stars can indicate how far the night has proceeded. In a similar way, the projected image can indicate how soon the wake-up time will be reached.

A further embodiment of the apparatus according to the invention is defined in claim 22. The sound producing device may be adapted to add sounds, such as nature sounds, for instance simulating the see, crickets, birds, toads etc. or music to the waking up or falling asleep process. Such sound can be adapted to comply with a wake-up period or a falling asleep period, in the first case for instance by starting with quiet music and ending with joyful music. In the latter case it can be the other way around.

According to another aspect, a method is provided for waking up a user, the method comprising producing a light effect (L), such as a light beam, from a light source that is adapted to produce the light effect that is directed toward a user, or at least toward a user's head, characterized in that the method comprises displacing the light effect in an upward or downward direction during a period of time, in order to change a position of the light effect with respect to the user, or at least to the user's head.

In an embodiment of the method the light effect can be displaced gradually during the time period. The light effect can start at a certain position with respect to a user's head, for instance substantially at the same level, and is displaced, for instance during the wake-up period until the user's final wake-up time is reached, along a certain amount of displacement.

In an embodiment of the method, the method comprises setting and controlling at least one parameter for waking up a person using a control unit. The control unit can control a user's final wake-up time and/or a length of the user's wake-up period until the final wake-up time is reached. The user can also determine the starting intensity and/or the end intensity of the light effect and also the start and/or end position of the light effect. Due to such control unit, the apparatus may be controlled according to a user's personal preferences. For instance, the user can decide on a length of an appropriate wake-up period, the final wake-up time and the end intensity of the light effect. Furthermore, such a control can be adapted to set multiple settings for instance separate settings for weekdays and different settings for the weekend or even to set the personal preferences for different users.

Further advantageous embodiments of an apparatus for waking up a user according to the present invention are set forth in the dependent claims.

BRIEF DESCRIPTION OF THE DRAWINGS

To explain the invention, exemplary, non limiting embodiments thereof will hereinafter be described with reference to the accompanying drawings, wherein.

It is noted that similar features are indicated by similar reference numerals in the different Figures.

DETAILED DESCRIPTION OF EMBODIMENTS

Figure 1A:
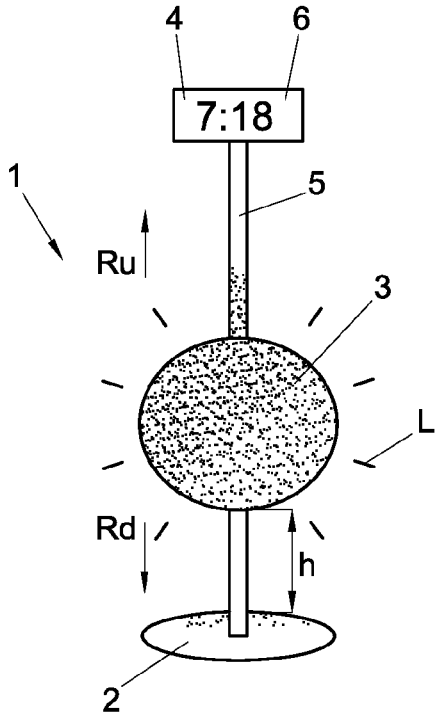
FIGS. 1*a*-1*b* schematically show a front view of an embodiment of the apparatus according to the invention.
Figure 1B:
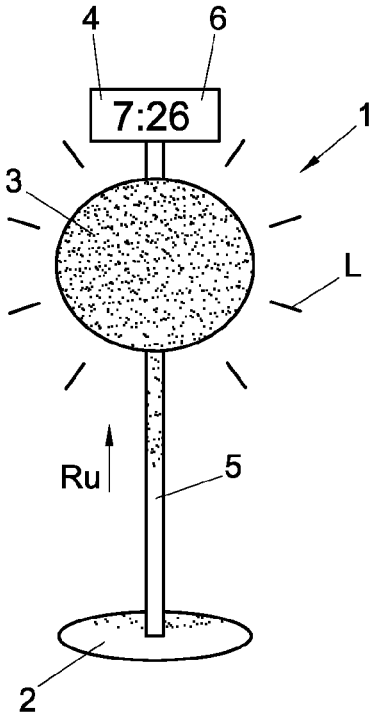

In FIGS. 1*a* and 1*b* a schematic representation of an embodiment of an apparatus 1 for waking up a user according to the invention is shown. The apparatus 1 comprises a base 2 and a light source 3. The apparatus 1 further comprises an information panel 4, for instance for indicating a time to the user. Such an information panel 4 can be arranged on the apparatus 1 on different locations, but can also be provided as a separate element communicating remotely and/or wireless with the control unit 6 of the apparatus 1.

The light source 3 is slideably arranged on a sliding element 5, in this case a pole that is attached to the base 2. The light source 3 is able to slide along the sliding element in an upward $R_u$ or a downward $R_d$ direction in order to displace the light beam L produced by said light source 3 in an upward $R_u$ or downward $R_d$ direction during a predetermined period of time. A user can set a wake-up time in a control unit 6 and optionally a wake-up period and other personal preferences if so desired. It is noted that a wake-up period is defined as a time period occurring before the final wake-up time set by the user. Such a wake-up period can for instance be about thirty minutes. The apparatus 1 according to the invention is adapted to simulate a natural sunrise. Therefore, the light source 3 will start to provide a light effect such as a light beam L at the beginning of the wake-up period (see FIG. 1*a*). Preferably, at the beginning of the wake-up period, the light beam L will have a relatively low intensity to resemble a sunrise. During the wake-up period the intensity of the light source 3 will increase and at the same time the light source 3 will rise. At the final wake-up time (see FIG. 1*b*), the light source 3 will have the final intensity preferably a higher intensity than the starting intensity, for instance an intensity with an intensity level set by the user. It is noted that the light effect can comprise different light radiation patterns dependent on the kind of light source 3 available in the apparatus 1. The control unit 6 can be arranged to control the intensity of the light beam during the wake-up period, or the length of the wake-up period, the starting intensity, the final intensity, the start position of the light beam L and/or the end position of the light beam L or the like.

In this embodiment, the user can set the start position of the light beam L by positioning the light source 3 at a certain height h with respect to the sliding element 5 (see FIG. 1*a*). Therefore, the sliding element 5 may be provided with a spring assembly (not shown) that is also connected to the light source 3. When the users pushes down the light source 3 in the downward direction $R_d$, the spring will elongate. At the beginning of the wake-up period, the spring will start to contract, thereby displacing the light source 3 in the upward direction $R_u$ until the light source 3 reaches the final position (see FIG. 1*b*). When the user wants to delay the wake-up period, he may push down the light source 3 again, in order to snooze. Of course, different ways of positioning of the light source 3 can be used in order to provide a displacement of the light source 3.

The apparatus 1 can further comprise an infrared source (not shown) in addition to the light source 3. The infrared source will radiate warmth at the user that has to be woken up. The increasing light intensity and the infrared radiation together provide for an even more natural sunrise.

According to another aspect of the invention, the apparatus 1 can also comprise connecting means (not shown) to operable connect the apparatus 1 to external devices (not shown), such as a television, a touch screen, an electronic display, a mobile phone, an audio system or the like. The apparatus 1 can for instance be connected to an audio system, such that a sound provided by the apparatus 1 will be reproduced by speakers of that audio system. The apparatus 1 can also be connected to other light sources in the room wherein the apparatus 1 is provided. When the light source 3 reaches the highest position, i.e. the sun has completely risen, the other light sources in the room can be controlled to produce light in the entire room.

According to a further aspect of the invention, the apparatus can comprise projection means (not shown) for projecting an image, such as a representation of the actual weather or the actual time onto a surface visible for the user, such as the ceiling.

Furthermore, the apparatus 1 can also comprise a sound producing device (not shown) for producing sound. During the sunset simulation, also a sound may be produced in order to enhance the wake-up efficiency of the apparatus 1. The apparatus 1 according to the invention is besides for waking up a user also suitable for using during a falling asleep period. The above described process will be reversed for the falling asleep period in order to simulate a sunset. By gradually decreasing a light intensity of the light effect L, a user can be pointed at a final sleeping time. When the intensity of the light effect is too low to be able to, for instance, read a book, the user knows that he has to stop reading and to try to fall asleep.

Since all further described embodiments can be provided with similar features as mentioned above at the description of the first embodiment, for the sake of clarity, for the following embodiments only the differences with respect to the first embodiment are elaborated on.

Figure 2A:
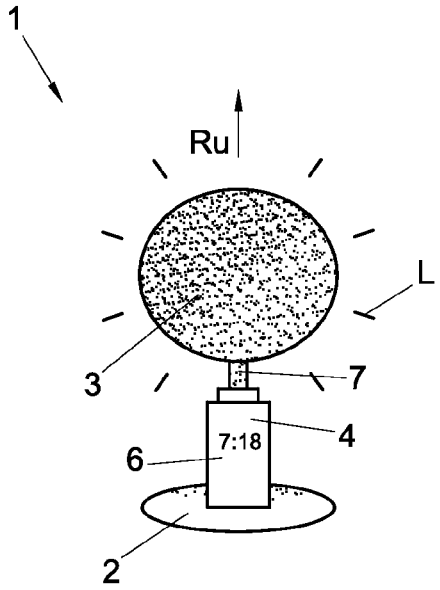
FIGS. 2*a*-2*b* schematically show a front view of a further embodiment of the apparatus according to the invention.
Figure 2B:
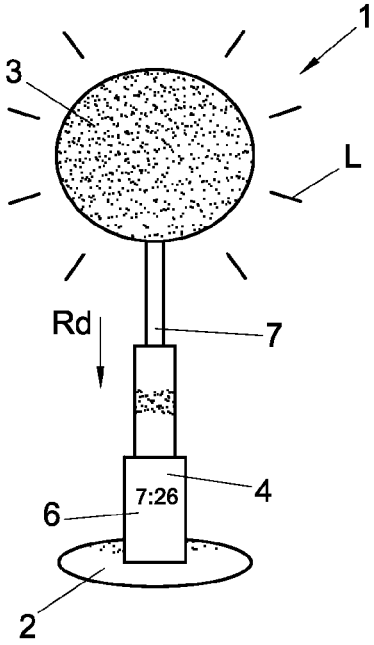

In FIGS. 2*a*-2*b* another embodiment of the apparatus 1 according to the invention is shown, that operates similarly to the above described embodiment. This embodiment differs from the first embodiment in that the light source 3 is displaceable by means of an extendable rod 7. In FIG. 2*a*, the light source 3 is in the initial position for waking up a user, thus the position at the beginning of the wake-up period, for instance at the same level as the user's head. The rod 7 is compressed and will start to extend at the beginning of the wake-up period. In FIG. 2*b*, the rod 7 is extended in the upward direction $R_u$ to a final position at the final wake-up time. The information panel 4 is provided between the base 2 and the rod 7. The extendable rod 7 may be provided with a spring assembly (not shown), wherein the spring will be compressed when the rod 7 is compressed. When the wake-up period starts, the extendable rod 7 is released such that it can gradually extend, thereby substantially simultaneously rising the light source 3. The light source 3 can have a relatively low intensity in the beginning position and can increase substantially simultaneously with the extension of the rod 7 in order to simulate the natural rising of the sun.

Figure 3A:
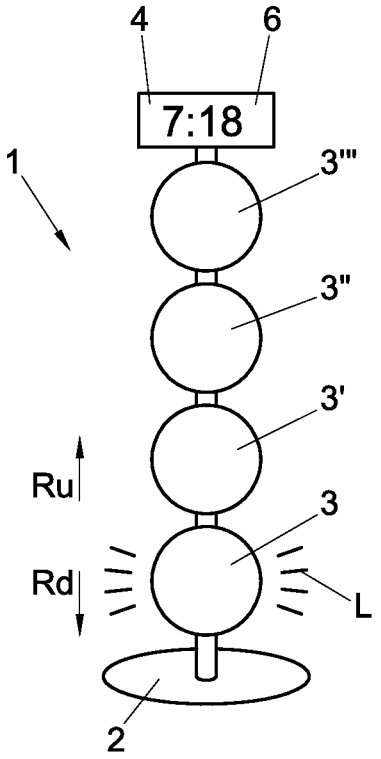
FIGS. 3*a*-3*b* schematically show a front view of a third embodiment of the apparatus according to the invention.
Figure 3B:
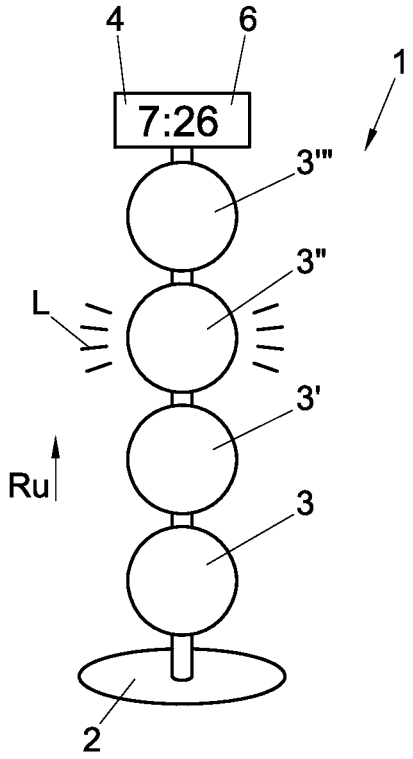

A further embodiment of the invention based on multiple light sources arranged in line above each other is illustrated in FIGS. 3*a*-3*b*. This embodiment differs from the above described embodiments in that the light beam is displaceable by means of multiple light sources 3, 3', 3", 3'". The light sources 3, 3', 3", 3'" are arranged in line substantially corresponding with the upward direction $R_u$, thus also with the downward direction $R_d$. The light sources 3, 3', 3", 3'" are adapted to produce the light beam L subsequently in order to displace the light beam L in an upward direction $R_u$ or downward direction $R_d$ by subsequently switching on and switching off the respective light sources 3, 3', 3", 3'". The amount of light sources 3, 3', 3", 3'" in FIGS. 3*a*-3*b* is an example, and can be different in another embodiment of the invention. The light sources 3, 3', 3", 3'" can be positionable such that each light source 3, 3', 3", 3' " can be directed in a slightly different direction. By doing so, the natural sunrise can be even more natural. The light source 3 arranged adjacent the base 2 can be directed relatively horizontal, and the light source arranged 3'" remote from the base 2 can be directed relatively vertical to shine towards a user's head.

Figure 4:
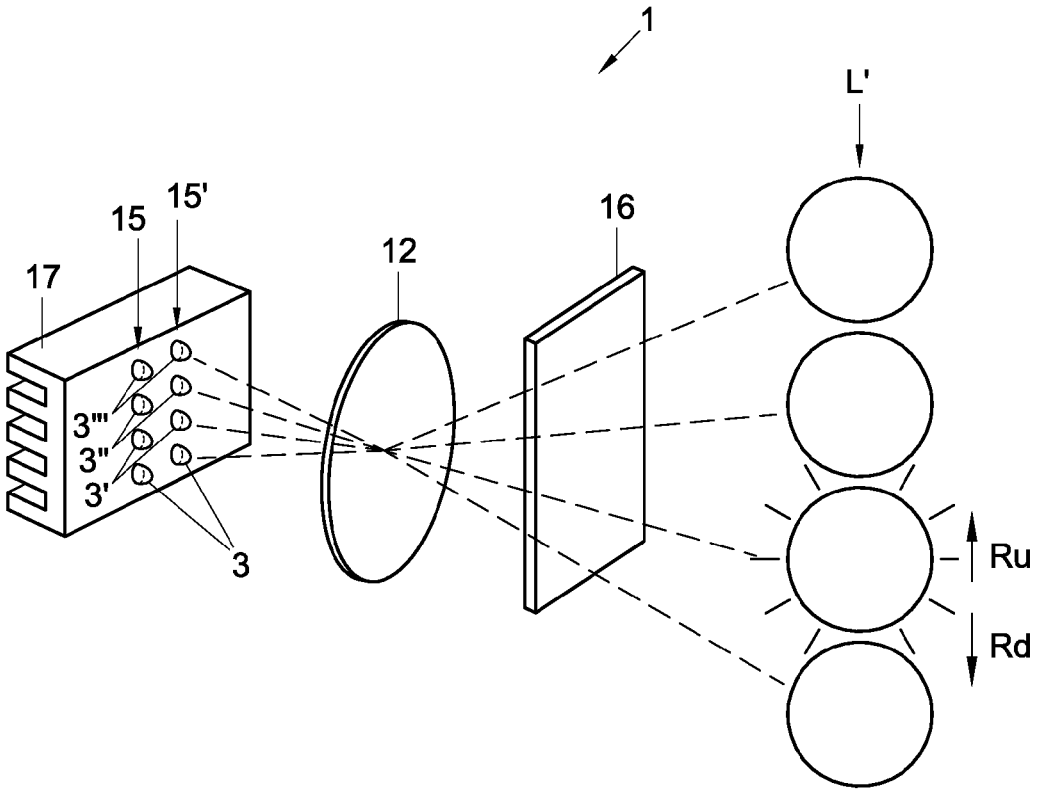
FIG. 4 schematically shows a side view of a fourth embodiment of the apparatus according to the invention.

Another embodiment of the invention, based on multiple light sources 3, 3', 3", 3'" arranged in line above each other, is illustrated in FIG. 4. The apparatus 1 shown in FIG. 4 comprises two lines 15, 15' of LED units 3, 3', 3", 3'". The lines 15, 15' are arranged substantially parallel and extend in a direction substantially parallel to the upward direction $R_u$. The LED units 3, 3', 3", 3'" may have different colors, which enables mimicking the change in perceived light color during a sunrise. For instance, the LED unit 3 adjacent the bottom of the apparatus 1 has a neutral white color. The LED unit 3' arranged directly above the neutral white LED unit 3 has a warm white color. The LED unit 3" arranged directly above the warm white LED unit 3' has an amber color and the upper LED unit 3'" has a red color. The upper LED unit 3'" could be, for example, a red LUXEON Rebel or LUXEON Rebel ES LED unit as available from Philips Lumileds. The different LED units 3, 3', 3", 3'" are mounted on a surface of a heat sink 17. Consequently, a very small light displacing means can be provided, which may be used in a relatively small apparatus 1 for waking up a user. In this example of the apparatus 1 according to the invention, the means for displacing the light effect L further comprises a lens 12, such as a Fresnel lens, to project four different light spots L' for instance on a wall next to a user's head. Each light spot L' has a different color dependent on the respective LED unit 3, 3', 3", 3'" that produces the light spot L', In this example, the means for displacing the light effect further comprises a diffuser 16, such as a holographic diffuser, to smooth the light spots L' such that the displacing light effect simulates a more natural sunrise. The apparatus 1 further comprises a control unit (not shown) that is adapted to control the different LED units 3, 3', 3", 3'" such that the intensity of the light spots L' and/or the color of the light spots L' may be gradually changed. For instance, the upper LED unit 3'" may be controlled to start emitting light, such that the lowest red light spot is provided. After a while, the control unit may control the second LED unit 3" to start emitting light such that a light spot L' with an amber color is provided slightly above the first lowest light spot L'. The lowest light spot L' may subsequently be dimmed, such that the light effect L' rises with respect to a user or a user's head. In the same manner, the other LED units 3', 3 may be controlled. In another embodiment of the invention, the lens 12 and/or the diffuser 16 may be omitted. In case the lens 12 is omitted, the red color LED unit 3''' may be provided at the lowest position in the line of LED units 3, 3', 3'', 3''' and the neutral white LED unit 3 may be provided at the highest position in the line of the LED units 3, 3', 3'', 3'''. Furthermore, LED units of different colors may be used, different amounts of LED units may be used and different amounts of lines of LED units may be used to provide the displaceable light effect. The lines of LED units may also be arranged in a different configuration and may extend in a different direction.

Figure 5:
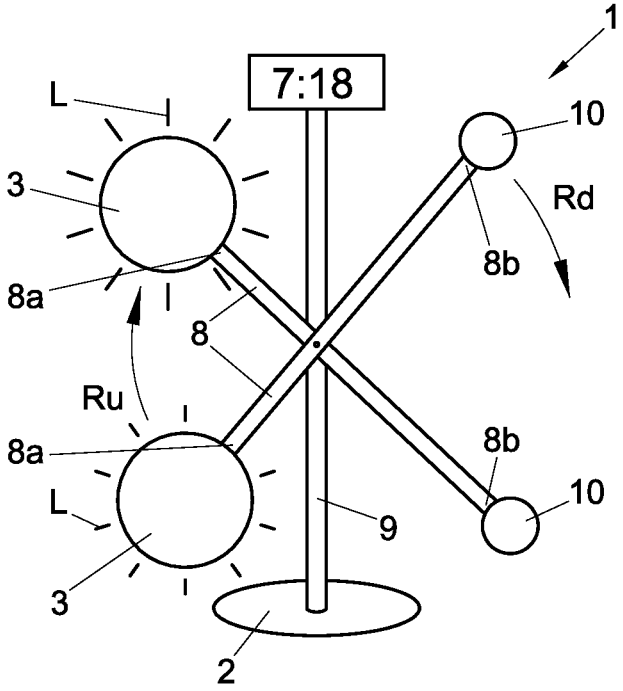
FIG. 5 schematically shows a front view of a fifth embodiment of the apparatus according to the invention.

In FIG. 5 a further embodiment of the invention is shown. This embodiment differs from the above mentioned embodiments in that the light source 3 is arranged at one end 8*a* of a rotating element 8 that is rotably arranged with respect to a stationary part 9 of the apparatus 1, more specific with respect to the base 2 of the light alarm clock 1. During the wake-up period, the rotating element 8 rotates in upward direction $R_u$ such that the light source 3 rotates in upward direction $R_u$. Therefore, at the other end 8*b* of the rotating element 8*a* counterweight 10 can be provided.

Figure 6A:
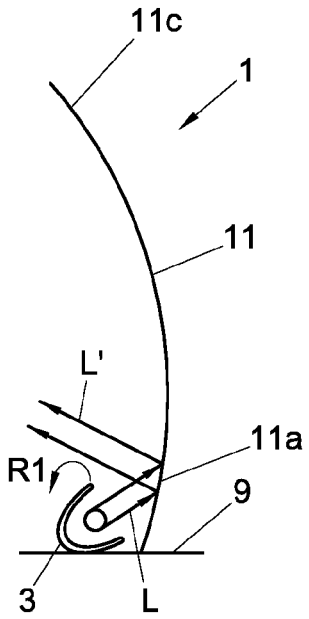
FIGS. 6*a*-6*c* schematically show a front view of a sixth embodiment of the apparatus according to the invention.
Figure 6B:
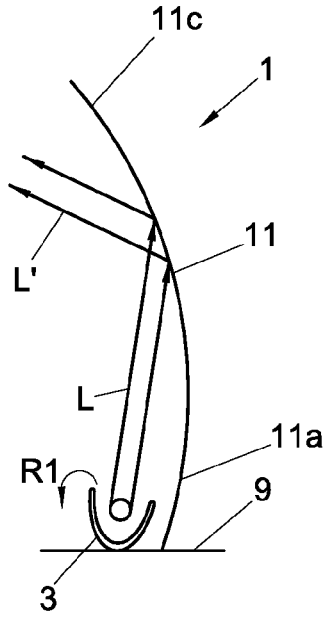
Figure 6C:
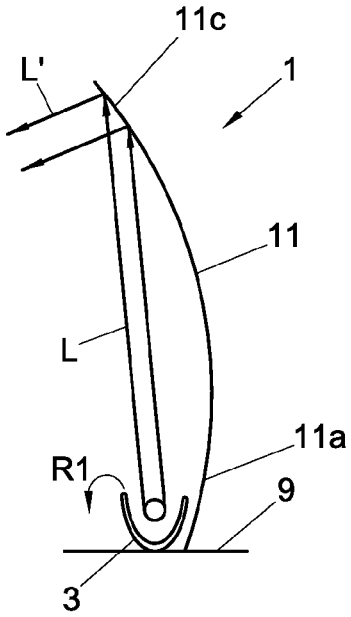

In the embodiment of the light alarm clock 1 as illustrated in FIGS. 6*a*-6*c*, the light source 3 is arranged adjacent a reflector 11. The light source 3 is rotatable arranged with respect to a stationary part 9 of the light alarm clock 1, and with respect to the reflector 11. The reflector 11 has an arc shape as can be seen in FIGS. 6*a*-6*c*. In FIG. 6*a*, the light source 3 is positioned such that it is directed to a lower part 11*a* of the reflector 11. The reflector 11 reflects the light beam L' in a direction extending from the reflector 11 towards the user. During the wake-up period, the light source 3 rotates in rotational direction $R_1$, thereby simultaneously rotating the light beam L from position 11*a* to position 11*c* on the reflector surface, such that the reflected light beam L' displaces in the upward direction $R_u$. The direction of the reflected light beam L' with respect to the user or the user's head changes as a result of the arc shaped reflector 11 during the rotation of the light source 3 as can be seen in FIGS. 6*a*-6*c*. At the end of the wake-up period (see FIG. 6*c*), thus when the final wake-up time is reached, the reflected light beam L' will be directed slightly downward, towards a user, of more preferably a user's head. In an alternative embodiment of the light alarm clock 1 according to the invention (not shown), the light source 3 may be arranged substantially stationary to the stationary part 9 of the light alarm clock 1. The reflector 11, on the other hand, may be arranged rotatable with respect to the stationary part 9. At the beginning of the wake-up period, the reflector 11 may be in such a position that an upper part of the reflector 11 is rotated towards the light source 3. In that case, the reflected light beam L' is directed towards the user or the user's head. During the wake-up period, the upper part of the reflector 11 is rotated in a direction opposite the rotational direction $R_1$ (that is indicated in FIGS. 6*a*-6*c*). Consequently, the reflected light beam L' is displaced in an upward direction $R_u$. At the end of the wake-up period, the reflected light beam L' will be directed substantially upward, thereby projecting the light effect for instance at a wall or the like.

Figure 7A:
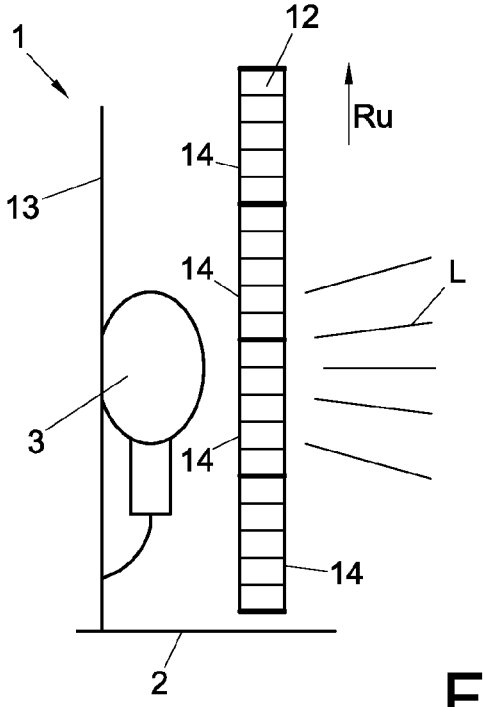
FIGS. 7*a*-7*b* schematically show a side view of a seventh embodiment of the apparatus according to the invention.
Figure 7B:
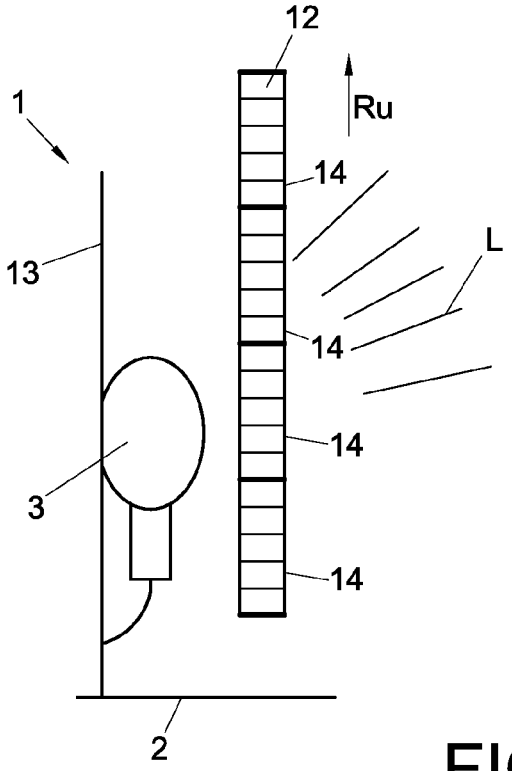

In another embodiment of the apparatus 1 according to the invention, as shown in FIGS. 7*a*-7*b*, the light beam L is displaceable by means of a displaceable Fresnel lens arrangement 12. The light source 3 is arranged stationary in a housing 13 of the apparatus 1. The Fresnel lens arrangement 12 is provided in front of the light source 3 and is in use situated between the light source 3 and the user. The Fresnel lens arrangement 12 comprises an array of Fresnel lenses 14 and is slidably arranged in the housing 13 with respect to the light source 3. At the beginning of a wake-up period, the Fresnel lens arrangement 12 is situated in the lowest position (see FIG. 7*a*). During the wake-up period, the lens arrangement 12 will be slid in an upward direction $R_u$, thereby displacing the light beam L until the final wake-up time is reached and the light beam L is in the most upper position (see FIG. 7*b*), or in a preset position determined by the user. Instead of a Fresnel lens arrangement 12 other lens arrangements can be used to displace the light beam L with respect to the user.

The invention is not in any way limited to the exemplary embodiments presented in the description and drawings. All combinations (of parts) of the embodiments shown and described are explicitly understood to be incorporated within this description and are explicitly understood to fall within the scope of the invention. Moreover, many variations are possible within the scope of the invention, as outlined by the claims. For instance, the means for displacing the light beam can be arranged in many different ways, by means of much different kind of light source assemblies. The embodiments described are examples of the claimed apparatus. Furthermore, different kinds of light sources can be used to provide the light beam. For instance, the light source 3 may comprise one or more lights, such as light bulbs, of similar or different colors. During the wake up period the color of the light effect may be changed by controlling the individual lights, such that for instance the light with the darkest color starts emitting light at the beginning of the wake up period and the light with the lightest color is emitting light at the end of the wake up period. Using lights with different colors enables mimicking the change in perceived light color during a sunrise. Also the intensity of the light effect may be changed by controlling the different lights, for instance such that the light intensity of the light source increased during the wake up period. The control unit can be adapted to store different kinds of parameters, settings and the like, for instance according to a user's preferences, the time of the year, pre-programmed patterns etc. Also, it is possible that the described elements of the apparatus are housed in a housing, in order to provide a nice looking alarm clock. Furthermore, any reference signs in the claims shall not be construed as limiting the scope of the invention.

The invention claimed is:

1. An apparatus for waking up a user, the apparatus comprising a light source for producing a light effect comprising a light beam directed toward a user's head, the apparatus comprising means for displacing the light source in an upward ($R_u$) or downward ($R_d$) direction during a period of time, in order to change a position of the light effect toward or away from the user's head, wherein the means to displace the light source is adapted to displace the light source gradually along an amount of displacement during a wake-up period until reaching a final wake-up time, wherein the means to displace the light source is arranged to start displacing the light source at a start position, then continuously displacing the light source along the amount of displacement and to end displacing the light source at an end position, wherein the apparatus is adapted to change an intensity of a light effect by starting the light effect with a dim light-intensity at a beginning of the time period and increasing the intensity of the light effect during the time period until the light effect has the final intensity at the end of the time period.

2. An apparatus according to claim 1, wherein the amount of displacement comprises a linear displacement path.

3. An apparatus according to claim 1, wherein the means for displacing the light source comprises a light source that is displaceable in the upward ($R_u$) or downward ($R_d$) direction in order to displace the light source.

4. An apparatus according to claim 3, wherein the light source is arranged on a sliding element of the apparatus, such that the light source is slidable in the upward ($R_u$) or downward ($R_d$) direction.

5. An apparatus according to claim 3, wherein the light source is provided on an extendable rod, such that the light source can be displaced by extending the rod in the upward ($R_u$) direction or by compressing the rod in the downward ($R_d$) direction.

6. An apparatus according to claim 1, wherein the apparatus comprises a control unit for setting and controlling at least one of: a final wake-up time, a length of a time period, a starting intensity of the light source, an end intensity of the light source, a start position of the light source, an end position of the light source, and a speed of displacement of the light effect.

7. An apparatus according to claim 1, wherein the apparatus is arranged to start displacing the light source at a beginning of a wake-up period, and to end displacing the light source a final wake-up time.

8. An apparatus according to claim 1, wherein the apparatus is arranged to control the light source such that the light source subsequently produces a light effect with a different intensity at the final wake-up time.

9. An apparatus according to claim 1, wherein the apparatus further comprises an infrared source for producing warmth to be radiated at the user.

10. An apparatus according to claim 1, wherein the apparatus comprises connecting means to operably connect the apparatus to external devices for using these devices to program the desired wake up time or falling asleep period or add rendering capabilities of the devices to an effect of the apparatus.

11. An apparatus for waking up a user, comprising a light source for producing a light effect including a light beam directed toward a user's head;

a displacing mechanism operably attached to the light source to displace the light source in an upward movement and a downward movement during a period of time in order to change a position of the light source;

wherein the displacement mechanism is adapted to displace the light source along an amount of displacement during a wake-up period until reaching a final wake-up time; the displacement mechanism arranged to start displacing the light source at a start position then displace the light source along the amount of displacement to an end position;

wherein the displacement mechanism displaces said light source in an upward or a downward direction.

12. An apparatus for waking up a user, the apparatus comprising:

a light source adapted to produce a light effect such as for producing a light effect of light beam directed toward a user;

means for displacing the light effect in an upward or downward direction during a period of time to change a position of the light effect with respect to the user;

wherein the means to displace the light effect is adapted to displace the light effect gradually along an amount of displacement during the time period until reaching a final wake-up time;

the apparatus adapted to change an intensity of the light effect by starting the light effect with a dim light-intensity at a beginning of the time period and increasing the intensity of the light effect during the time period until the light effect has the final intensity at the end of the time period.

13. The apparatus of claim 12 wherein the means for displacing the light effect includes a light source and a reflector, at least one of the light source and the reflector is rotatable arranged in the apparatus in order to rotate the light effect around a rotational axis substantially perpendicular to the upward and downward direction, wherein the reflector is arranged adjacent to the light source to direct the light effect towards the user.

* * * * *